US008464692B2

(12) United States Patent
Boecking

(10) Patent No.: US 8,464,692 B2
(45) Date of Patent: Jun. 18, 2013

(54) DEVICE FOR SUPPLYING AN INTERNAL COMBUSTION ENGINE WITH FUEL

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 300 days.

(21) Appl. No.: 13/060,192

(22) PCT Filed: Jul. 6, 2009

(86) PCT No.: PCT/EP2009/058469

§ 371 (c)(1),
(2), (4) Date: Mar. 17, 2011

(87) PCT Pub. No.: WO2010/020464

PCT Pub. Date: Feb. 25, 2010

(65) Prior Publication Data

US 2011/0192377 A1 Aug. 11, 2011

(30) Foreign Application Priority Data

Aug. 20, 2008 (DE) ..... 10 2008 041 384

(51) Int. Cl.
*F02M 69/52* (2006.01)

(52) U.S. Cl.
USPC ..... 123/457; 123/511

(58) Field of Classification Search
USPC ..... 123/457, 458, 510, 511, 512, 496, 123/456; 701/104
See application file for complete search history.

(56) References Cited

U.S. PATENT DOCUMENTS

| | | | | |
|---|---|---|---|---|
| 3,531,936 | A * | 10/1970 | Widell | 60/39.281 |
| 4,213,741 | A * | 7/1980 | Rogers et al. | 417/79 |
| 5,207,203 | A | 5/1993 | Wagner et al. | |
| 5,558,068 | A | 9/1996 | Kunishima et al. | |
| 5,762,033 | A * | 6/1998 | Rembold et al. | 123/25 C |
| 7,178,335 | B2 * | 2/2007 | Bickley | 60/426 |
| 2002/0000219 | A1 * | 1/2002 | Augustin et al. | 123/502 |
| 2006/0185647 | A1 | 8/2006 | Rapp | |

FOREIGN PATENT DOCUMENTS

WO 2005010351 A1 2/2005

* cited by examiner

*Primary Examiner* — Mahmoud Gimie
(74) *Attorney, Agent, or Firm* — Michael Best & Friedrich LLP

(57) ABSTRACT

The invention relates to a device for supplying an internal combustion engine with fuel, having a fuel reservoir and a high-pressure pump, which are connected through a suction line, a metering valve which effects a change of the passage cross-section of the suction line, a rail for receiving high-pressure fuel, and a pressure control valve for controlling the pressure in the rail. The metering valve and the pressure control valve are combined in a common housing and have opposite opening directions. The metering valve and the pressure control valve have closing members which are rigidly connected to each other and are movable on a coincident movement axis.

20 Claims, 2 Drawing Sheets

DEVICE FOR SUPPLYING AN INTERNAL COMBUSTION ENGINE WITH FUEL

CROSS-REFERENCE TO RELATED APPLICATION

This application is a 35 USC 371 application of PCT/EP 2009/058469 filed on Jul. 6, 2009.

BACKGROUND OF THE INVENTION

1. Field of the Invention

The invention is based on a device for supplying an internal combustion engine with fuel.

2. Description of the Prior Art

One such device is known from German Patent Disclosure DE 102 47 564 A1. In it, the fuel is delivered to the suction valve of a high-pressure pump with the aid of a fuel pump, metered as a function of demand via a metering unit; the fuel in the high-pressure pump is compressed to a pressure of up to 1600 bar and is fed via a high-pressure valve into a high-pressure reservoir, the so-called rail, to which the injection nozzles of an internal combustion engine are connected. They effect the actual injection of the fuel required for operation into the combustion chambers of the engine.

As a function of the rpm, an internal combustion engine requires variously large amounts of fuel. To have adequate amounts of fuel available in the rail under all operating conditions, the high-pressure pump is designed for the maximum possible demand of the associated engine. However, this has the disadvantage that in the partial-load range, unnecessarily large amounts of fuel are delivered to the rail and carried back into the fuel reservoir via an overpressure valve, which from an energy standpoint is not very satisfactory. To overcome this disadvantage, the fuel amount supplied to the high-pressure pump is metered as a function of the demand at the time, with the aid of the metering unit. The overpressure valve and the metering valve are separate, independent functional units. This increases the risk that overpressure will occur in the rail, and that mechanical damage from pressure can occur in the rail, the connecting lines, and/or the metering unit.

ADVANTAGES AND SUMMARY OF THE INVENTION

The device of the invention has the advantage that a pressure regulating valve and a metering unit are no longer required as autonomous, mutually independent functional units but instead reinforce one another in their effect. The entire functional unit is therefore extremely sturdy and functionally reliable. Damage caused by overpressure in the vicinity of the rail, the lines and the metering unit can as a result be reliably avoided.

An embodiment according to the invention has the advantage that the two valves cannot interfere with one another in their effect, and that in at least one of the valves, in the closed state, absolute tightness is ensured.

The invention has the advantage of especially good durability and especially little wear.

The invention has the advantage that the piston can be rotated in the cylinder, without changing the functional reliability. This simplifies the assembly considerably.

According to the invention a piston of T-shaped profile is received in a cylinder of T-shaped profile adapted to it; the recess, as an annular cylinder, opens when the piston is displaced in the longitudinal direction in the cylinder. In the same manner, the recess becomes smaller when the magnitude of the relative displacement is decreased. The structural shape is especially simple to produce and to assemble.

If the cylinder and the piston are of the same cross section throughout the entire length, a similar effect can be attained if the recess, by an annular groove, and the piston is optionally transversely penetrated by a supplementary bore.

The rigid connection between the closing members of the metering valve and the pressure regulating valve can be generated most easily if the closing members are connected by a thrust rod.

The device according to the invention can be arbitrarily triggered very precisely, and thus the fuel supply to an internal combustion engine can be controlled very precisely and optimally.

The invention offers the advantage that the annular magnet has to be operative in only one direction. The precise triggering is simplified considerably as a result.

BRIEF DESCRIPTION OF THE DRAWINGS

A plurality of exemplary embodiments of the invention are shown in the drawings and described in further detail in the ensuing description in conjunction with the drawings, in which.

DESCRIPTION OF THE PREFERRED EMBODIMENTS

Figure 1:
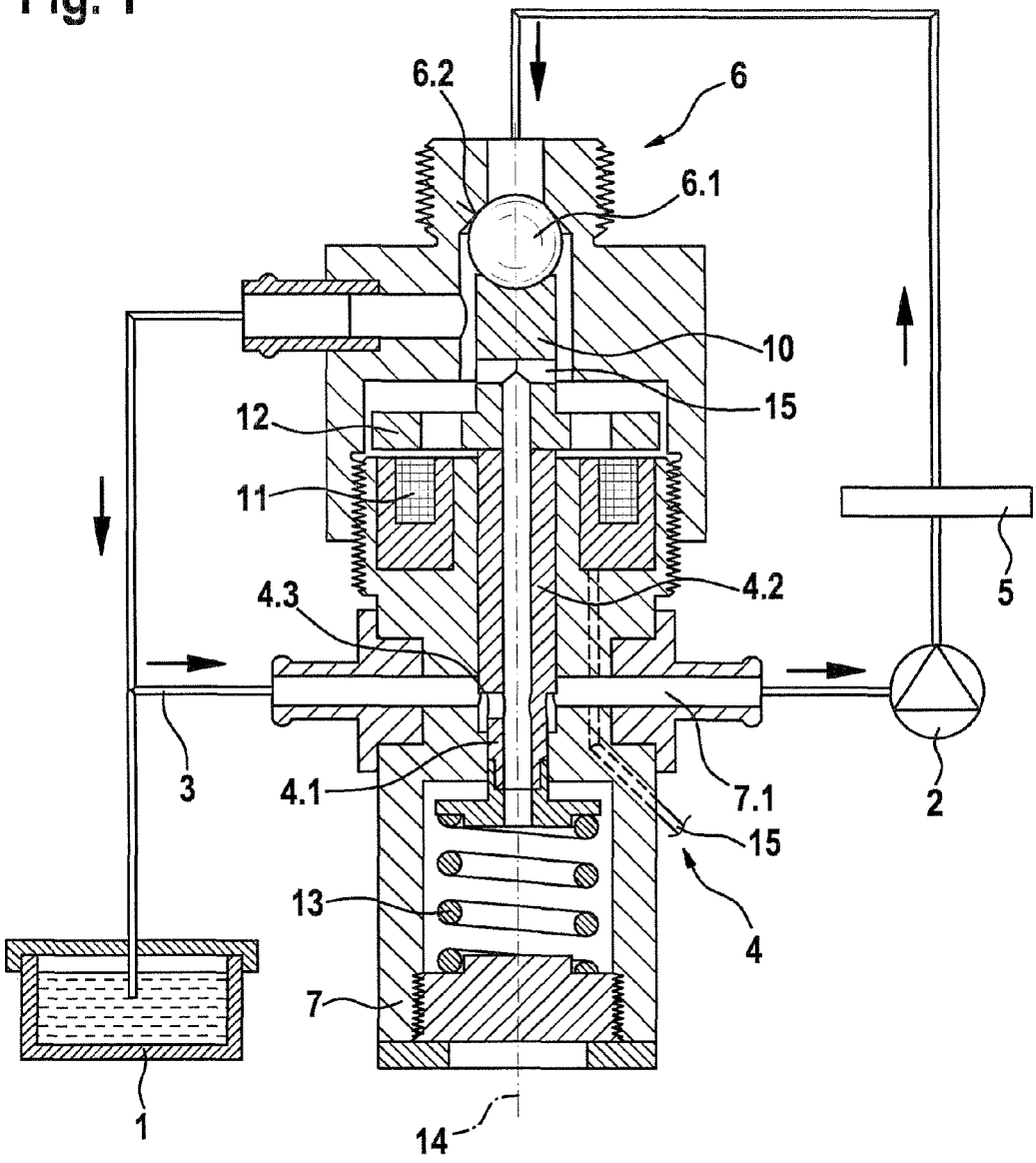
FIG. 1 shows the fundamental construction of a device of the invention.

In the drawings, identical reference numerals designate items that are functionally identical.

The device shown in FIG. 1 serves to supply an internal combustion engine with fuel. It includes a fuel reservoir 1 and a high-pressure pump 2, which communicate through an intake line 3; a metering valve 4, which effects a change in the flow cross section of the intake line 3; a rail 5 for receiving fuel at high pressure; and a pressure regulating valve 6 for regulating the pressure in the rail 5.

The metering valve 4 and the pressure regulating valve 6 are united in a common housing 7 and have opposed opening directions; the metering valve 4 and the pressure regulating valve 6 have closing members 4.1, 6.1, which are rigidly connected to one another and are displaceable on a coinciding movement axis 14 only in the same direction and jointly.

Only one of the closing members 6.1, namely the closing member of the pressure regulating valve 6, can be applied directly to a valve seat 6.2, while the other is designed as a stopless slide 4.2. Both valves are as a result distinguished by especially good functional reliability.

The closing member 6.1 of the pressure regulating valve 6 that can be pressed against the valve seat 6.2 is a ball. Accordingly, it is very simple to produce, and it is distinguished by especially low wear and high functional reliability.

The passability of the pressure regulating valve 6 is determined by the spacing of the ball from the associated valve seat 6.2 at the time.

The slide 4.2 of the metering valve 4 is formed by a piston, received in a conduit of the housing 7 and displaceable in the longitudinal direction; the housing 7 is penetrated transversely by a transverse bore 7.1 within the length of the piston, and the piston is slidable in sealing fashion with a control edge 4.3 upstream of the inlet openings, toward the conduit, of the transverse bore 7.1. Depending on the particular position of the control edge 4.3 of the piston upstream of the inlet openings toward the conduit, the flow cross section of these openings and thus at the same time the flow cross section of the intake line 3 are varied.

For opening the transverse bore 7.1, the piston is provided with at least one recess, which can be made to coincide with the inlet openings, toward the conduit, of the transverse bore 7.1. The control edge 4.3 is formed by the edge in which the transverse bore and the jacket face of the piston border one another.

Figure 2:
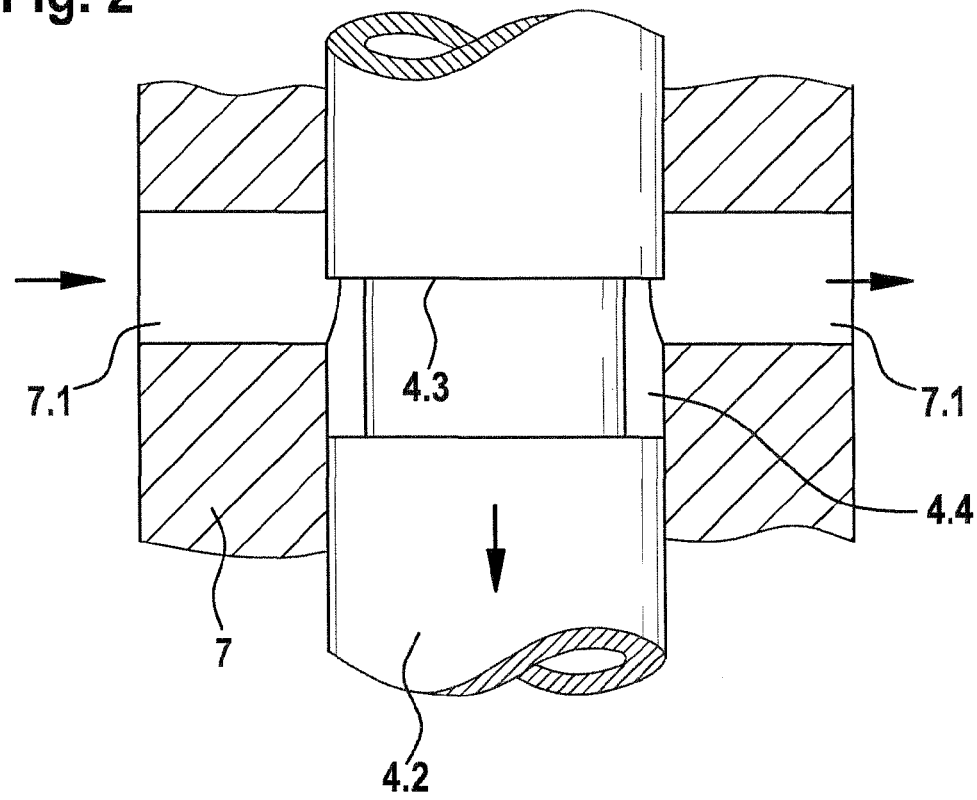
FIG. 2 shows a detail of FIG. 1, in which the piston of the metering valve is surrounded by an annular groove that can be made to coincide with the orifices of the intake line.

FIG. 2 shows a first model, in which the piston, for forming the recess, is surrounded by a radially outward-opening annular groove 4.4 and/or is penetrated transversely by a supplementary bore that can be made to coincide with the transverse bore 7.1. The control edge 4.3 is formed by a circular-annular face that defines the jacket face of the piston.

Figure 3:
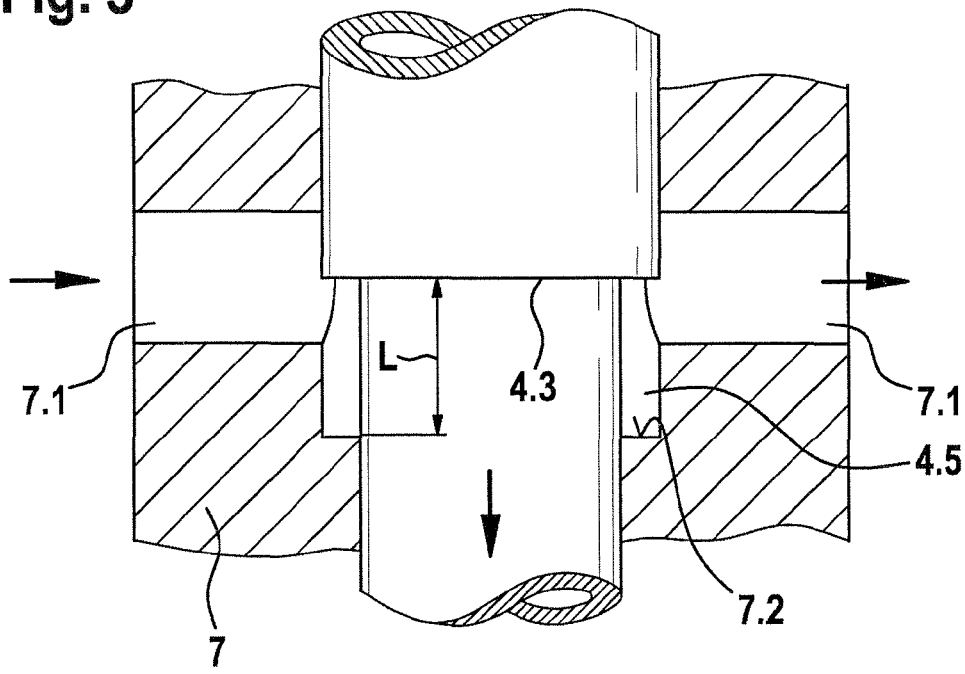
FIG. 3 shows a detail of FIG. 1, in which the piston and the cylinder receiving it have a graduatedly reduced cross section, creating a hollow-cylindrical chamber surrounding the piston that can be made to coincide with the orifices of the intake line, when the piston is displaced in the longitudinal direction relative to the cylinder.

FIG. 3 shows a second model, in which the control edge 4.3 defines a first circular-annular face of the piston radially outward, which circular-annular face is disposed between a first axial region of the piston of a greater cross section and a second axial region of the piston of a graduatedly reduced cross section; the conduit has two axial regions, which with regard to the graduation of the cross sections are adapted to the shape of the piston and which are separated by a second circular-annular face 7.2, and the recess is formed by the annular chamber 4.5 between the piston and the conduit, which annular chamber is created when the circular-annular faces of the piston and of the conduit have a spacing L from one another in the longitudinal direction.

In the design of FIG. 1, the closing members 4.1, 6.1 are mechanically rigidly connected by a thrust rod 10. This makes special calibration unnecessary. The thrust rod 10 surrounds the magnet coil 11 and has an armature 12 of iron, which is disposed in the magnetic field of the magnet coil 11. The magnet coil 11 can be acted upon and actuated with electrical voltage by means of a power cord 15.

The thrust rod 10 and the armature 12 are penetrated by bores 15, in order to reduce the amounts of inertia and to improve the movability, when the hollow spaces in the functional unit are all filled with fuel. This can be expedient in order to avoid sealing problems with regard to parts movable relative to one another. Subjecting the electromagnet to current, which can be done under computer control, causes a change in the spacing between the armature 12 and the magnet coil 11, and this change is utilized for intentionally changing the passability of both the pressure regulating valve 6 and the metering valve 4 as needed. In the design of FIG. 1, the magnet coil 11 is operative counter to the force of a compression spring 13 that engages the slide 4.2 and/or the thrust rod 10. With the magnet coil 11 not switched, the compression spring causes the closing member of the pressure regulating valve 6 to be pressed against its valve seat and causes opening of the total available flow cross section of the metering valve 4 of the intake line 3. The high-pressure pump 2 is as a result maximally supplied with fuel, and the rail 5 is very quickly filled with fuel that in the rail has the requisite pressure for supplying the engine connected to it. Once that pressure is reached, a shutoff is then initiated via the electromagnet; this comprises simultaneously opening the pressure regulating valve to the requisite extent and closing the metering valve. A correspondingly reduced amount of fuel is delivered to the high-pressure pump and fed into the rail and diverted from there to a correspondingly lesser extent. The cross section of the relief line is dimensioned as large enough that the maximum delivery volume to the high-pressure pump 3 can be returned as needed in its entirety by that way to the fuel reservoir 2. As a result, damage from overpressure need no longer be feared. As a result, at minimum drive power of the high-pressure pump 2, at all rpm levels of the engine connected to it, it is always the constant pressure required for operation that prevails in the rail.

The foregoing relates to the preferred exemplary embodiments of the invention, it being understood that other variants and embodiments thereof are possible within the spirit and scope of the invention, the latter being defined by the appended claims.

The invention claimed is:

1. A device for supplying an internal combustion engine with fuel, including:

a fuel reservoir and a high-pressure pump, which communicate through an intake line;

a metering valve, which effects a change in a flow cross section of the intake line;

a rail for receiving fuel subjected to high pressure; and a pressure regulating valve for regulating the pressure in the rail, wherein the metering valve and the pressure regulating valve are united in one common housing and have opposite opening directions, and the metering valve and the pressure regulating valve have closing members, which are rigidly connected to one another and are displaceable along a coinciding movement axis.

2. The device as defined by claim 1, wherein only one of the closing members can be applied against a valve seat, and the other is designed as a stopless slide.

3. The device as defined by claim 2, wherein closing member that can be pressed against the valve seat is a ball.

4. The device as defined by claim 2, wherein the slide is formed by a longitudinally displaceable piston received in a conduit of the housing, the housing is penetrated transversely within the length of the piston by a transverse bore, and the piston is slidable by a control edge sealingly upstream of the outlet openings, toward the conduit, of the transverse bore.

5. The device as defined by claim 4, wherein the control edge defines a radially outward-opening annular groove of the piston and surrounds the piston entirely with a circular-annular face.

6. The device as defined by claim 4, wherein the control edge defines a first circular-annular face of the piston radially on the outside, which circular-annular face is disposed between a first axial region of the piston of a greater cross section and a second axial region of a graduatedly reduced cross section, the conduit has two axial regions, which in terms of the graduation of the cross sections are adapted to the shape of the piston and are separated by a second circular-annular face, and the recess is formed by an annular chamber between the piston and the conduit, which annular chamber results when circular-annular faces of the piston and of the conduit have a spacing from one another in a longitudinal direction.

7. The device as defined by claim 5, wherein for forming the recess, the piston is surrounded by an annular groove and/or is transversely penetrated by a supplementary bore that can be made to coincide with the transverse bore.

8. The device as defined by claim 1, wherein the closing members are rigidly connected by a thrust rod.

9. The device as defined by claim 2 wherein the closing members are rigidly connected by a thrust rod.

10. The device as defined by claim 3, wherein the closing members are rigidly connected by a thrust rod.

11. The device as defined by claim 4, wherein the closing members are rigidly connected by a thrust rod.

12. The device as defined by claim 5, wherein the closing members are rigidly connected by a thrust rod.

13. The device as defined by claim 6, wherein the closing members are rigidly connected by a thrust rod.

14. The device as defined by claim 7, wherein the closing members are rigidly connected by a thrust rod.

15. The device as defined by claim 5, wherein the thrust rod surrounds a magnet coil and has an armature, which is disposed in the magnetic field of the magnet coil.

16. The device as defined by claim 6, wherein the thrust rod surrounds a magnet coil and has an armature, which is disposed in the magnetic field of the magnet coil.

17. The device as defined by claim 7, wherein the thrust rod surrounds a magnet coil and has an armature, which is disposed in the magnetic field of the magnet coil.

18. The device as defined by claim 15, wherein the magnet coil is operative counter to the force of a compression spring that engages the slide and/or the thrust rod.

19. The device as defined by claim 16, wherein the magnet coil is operative counter to the force of a compression spring that engages the slide and/or the thrust rod.

20. The device as defined by claim 17, wherein the magnet coil is operative counter to the force of a compression spring that engages the slide and/or the thrust rod.

* * * * *

UNITED STATES PATENT AND TRADEMARK OFFICE

CERTIFICATE OF CORRECTION

PATENT NO. : 8,464,692 B2
APPLICATION NO. : 13/060192
DATED : June 18, 2013
INVENTOR(S) : Friedrich Boecking It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 289 days.

Signed and Sealed this
Eighth Day of September, 2015

Michelle K. Lee

Michelle K. Lee
*Director of the United States Patent and Trademark Office*